US005411178A

United States Patent [19]

Roders et al.

[11] Patent Number: 5,411,178

[45] Date of Patent: May 2, 1995

[54] FLUID DISPENSER POUCH WITH VENTURI SHAPED OUTLET

[75] Inventors: George W. Roders, Kenosha; Stewart Banks, Brantford, Canada

[73] Assignee: Beeton Holdings Limited, St Peter Port, Channel Islands

[21] Appl. No.: 208,884

[22] Filed: Mar. 11, 1994

[51] Int. Cl.[6] ..... B65D 37/00

[52] U.S. Cl. ..... 222/105; 222/107; 222/214; 222/541

[58] Field of Search ..... 222/92, 94, 95, 105, 222/107, 491, 494, 541, 207, 214, 212

[56] References Cited

U.S. PATENT DOCUMENTS

| | | | |
|---|---|---|---|
| 3,184,121 | 5/1965 | Wolckening | 222/541 X |
| 3,418,059 | 12/1968 | Robe | 222/107 X |
| 3,815,794 | 6/1974 | Carlisle | 222/107 X |
| 3,881,641 | 5/1975 | Pliml, Jr. et al. | 222/214 X |
| 3,930,761 | 1/1976 | Barraclough | 222/214 |
| 4,256,242 | 3/1981 | Christine | 222/214 X |
| 4,463,876 | 8/1984 | Swallert | 222/214 X |
| 4,491,245 | 1/1985 | Jamison . | |
| 4,513,885 | 4/1985 | Hogan | 222/214 X |
| 4,564,127 | 1/1986 | Garabedian et al. . | |
| 4,667,854 | 5/1987 | McDermott et al. | 222/214 X |
| 4,793,121 | 12/1988 | Jamison . | |
| 4,932,562 | 6/1990 | Christine | 222/214 X |
| 4,935,283 | 6/1990 | Jamison . | |
| 5,000,350 | 3/1991 | Thomsen . | |
| 5,018,646 | 5/1991 | Billman et al. . | |
| 5,067,635 | 11/1991 | Thomsen . | |

FOREIGN PATENT DOCUMENTS

| | | | |
|---|---|---|---|
| 735289 | 5/1966 | Canada | 222/107 |
| 8908587 | 9/1989 | WIPO | 222/494 |

*Primary Examiner*—Kevin P. Shaver
*Attorney, Agent, or Firm*—Lynn C. Schumacher

[57] ABSTRACT

A pliable, fluid dispensing pouch is provided which includes a flexible shot-chamber having a venturi shaped outlet passageway leading to a discharge opening at one end of the pouch. The discharge opening is initially sealed closed by the presence of a sealing tab. The discharge opening is unsealed by tearing off the tab. The venturi shaped outlet passageway has a throat section in which a liquid meniscus forms during use which acts to prevent leakage from the pouch when not in use.

14 Claims, 4 Drawing Sheets

FLUID DISPENSER POUCH WITH VENTURI SHAPED OUTLET

FIELD OF THE INVENTION

The present invention relates to flexible pouches for holding and dispensing fluids such as liquid cleaning agents, foodstuffs, and the like.

BACKGROUND OF THE INVENTION

This invention relates to improved flexible, fluid dispenser pouches for use with associated fluid dispensers. In particular, this invention relates to flexible pouches for holding fluids such as liquid detergents and foodstuffs. An example of a flexible pouch of this nature is disclosed in U.S. Pat. No. 4,491,245. The pouch disclosed in this patent has an outlet passageway having a serpentine geometry such that fluid is prevented from freely flowing out of the pouch but can be expelled using hand or finger pressure.

These fluid pouches are prone to leaking a small amount of residual fluid in use when being handled. Leakage poses a problem particularly when removing empty or near empty pouches containing a small amount of residual fluid which can spill causing a mess. Also, with higher viscosity liquids, stringing becomes a problem wherein liquid strings hang from the discharge outlet which dry out and block the outlet.

Accordingly, it would be advantageous to provide a pouch having an outlet passageway structured to automatically seal when not in use thereby preventing leakage.

SUMMARY OF THE INVENTION

The subject invention provides a pliable, flexible pouch for storing liquids therein. The pouch comprises flexible, liquid impermeable superposed sheets each having a peripheral edge. The superposed sheets are attached together in liquid-tight relation along the peripheral edges to enclose therebetween a liquid storage compartment and a flexible shot-chamber in flow communication with the liquid storage compartment. The pouch includes a venturi shaped outlet passageway extending from the flexible shot-chamber to an associated liquid discharge opening located at the peripheral edge of the liquid tight seal. The pouch includes detachable closure means attached to the pouch for blocking the discharge opening prior to use of the pouch.

In another aspect of the invention there is provided a pouch having a storage compartment and a flexible shot-chamber. The pouch is used to store liquid which is to be dispensed from a dispenser which comprises a dispenser station through which the fluid is to be dispensed along a dispenser path that extends therethrough. The dispenser includes a backstop on one side of the dispenser path and a cam means confronting the backstop and located on the other side of the dispenser path. The dispenser includes manual activation means for actuating the cam means to move the cam means downwardly along a backstop with the flexible shot-chamber between the cam means and the backstop to expel a quantity of fluid from the dispenser. The improvement of the flexible pouch comprises a venturi shaped outlet passageway extending from the flexible shot-chamber to an associated liquid discharge opening located at the peripheral edge of the liquid tight seal.

BRIEF DESCRIPTION OF THE DRAWINGS

The following is a description, by way of example only, of the pouch forming the present invention, reference being had to the accompanying drawings, in which.

DETAILED DESCRIPTION OF THE INVENTION

Figure 1:
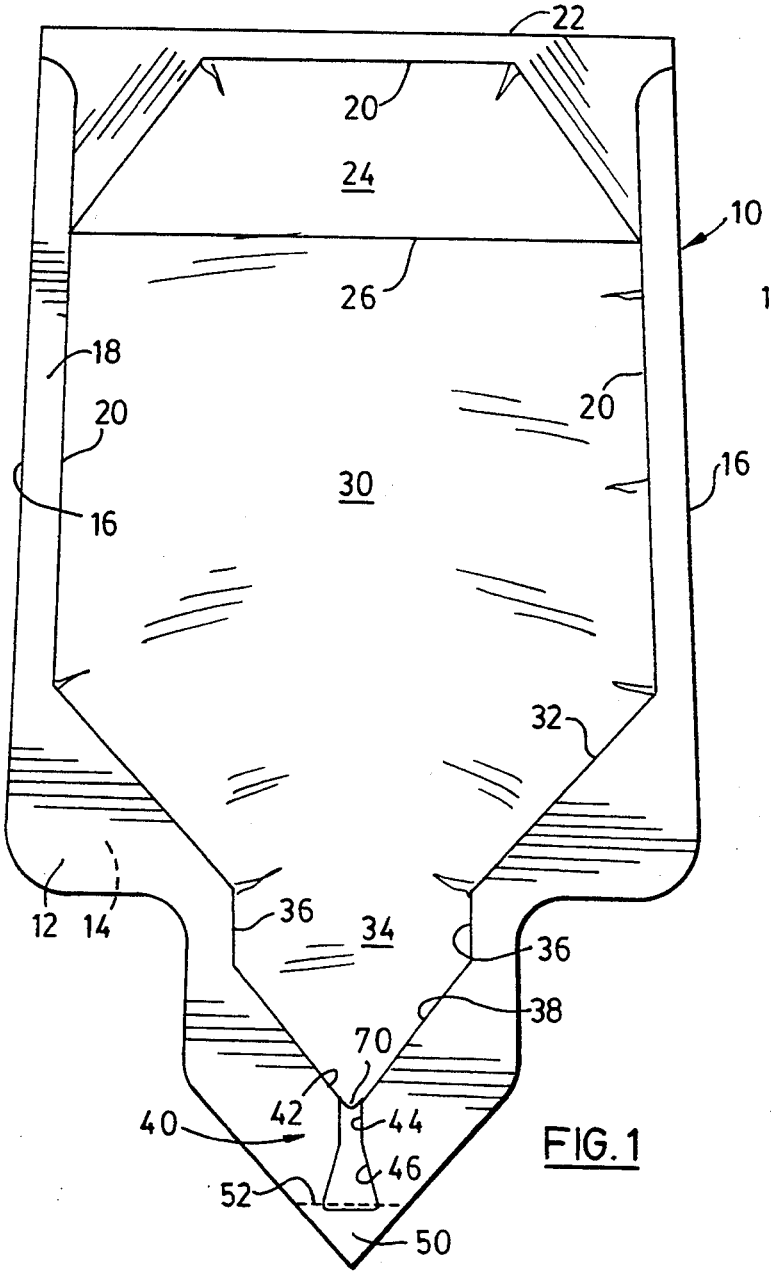
FIG. 1 is a plan view of a flexible pouch constructed in accordance with the present invention.
Figure 3:
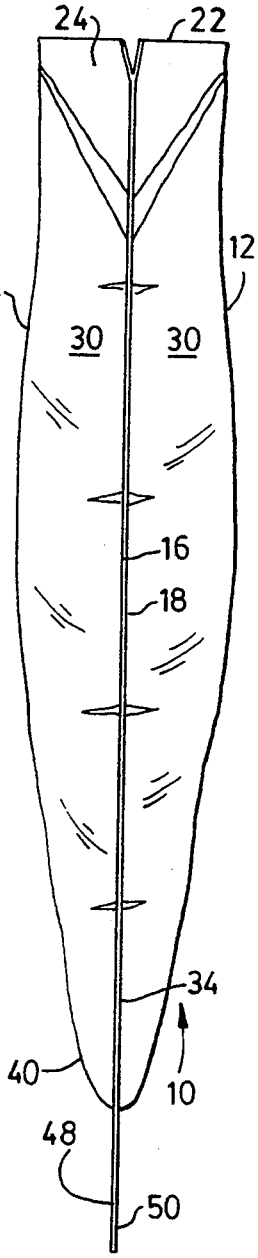
FIG. 3 is a side elevational view of the pouch of FIG. 1 filled with fluid.

Referring to FIGS. 1 and 3, a pliable, flexible pouch 10 forming the subject invention comprises two liquid impermeable, flexible superposed sheets 12 and 14 having peripheral edges 16 and fabricated of a flexible sheet material such as plastic wherein the two sheets are in overlaying relationship. Sheets 12 and 14 are fabricated of a tear and puncture resistant material. Sheets 12 and 14 are sealed together along a peripheral boundary region 18 located between edges 16 of the sheets and a line 20 spaced inwardly from edge 16, best seen FIG. 1.

Pouch 10 in the empty state as illustrated in FIG. 1 is gusseted at the upper end 22 thereof in the area 24 bounded by lines 20 and 26. The two sheets 12 and 14 are sealed together and define a flexible, main storage compartment 30. Compartment 30 has a lower tapered portion 32 at its lower end which is in flow communication with a lower, flexible shot-chamber 34. Flexible shot chamber 34 has a funnel shape with parallel edges or seams 36 and tapered edges 38.

Flexible pouch 10 is used in conjunction with a fluid dispenser. A variety of dispensers may be used. Usually the dispenser comprises a chamber for containing the pouch, a hand actuated roller for pressing against and squeezing the pouch and an aperture for passing the discharge opening of the pouch therethrough. The roller rolls along the pouch to squeeze the contents of the pouch through discharge opening 48.

The shot chamber is that portion of the pouch over which the roller of a fluid dispenser passes, to be more fully discussed below. Therefore, it is the volume of liquid contained within the shot chamber which is expelled during use.

Figure 2:
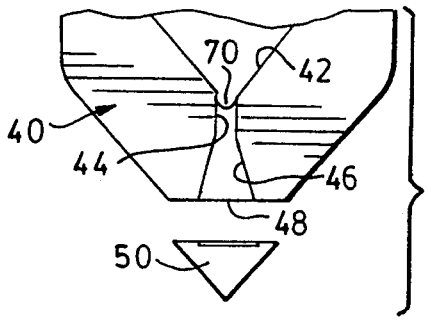
FIG. 2 is a plan view, broken away, of the outlet portion of the pouch shown in FIG. 1.

Referring to FIGS. 1 and 2, pouch 10 includes a venturi shaped outlet passageway shown generally at 40. The venturi shaped outlet passageway 40 includes a first tapered section 42 leading from shot chamber 34 to a throat section 44, and a second tapered section 46 leading from throat section 42 to a liquid discharge opening 48. A detachable closure member or sealing tab 50 is attached to pouch 10 along a weakened line 52 (FIG. 1) prior to use and is detached (FIG. 2) when in use. Discharge opening 48 is formed when closure member 50 is detached.

Figure 4:
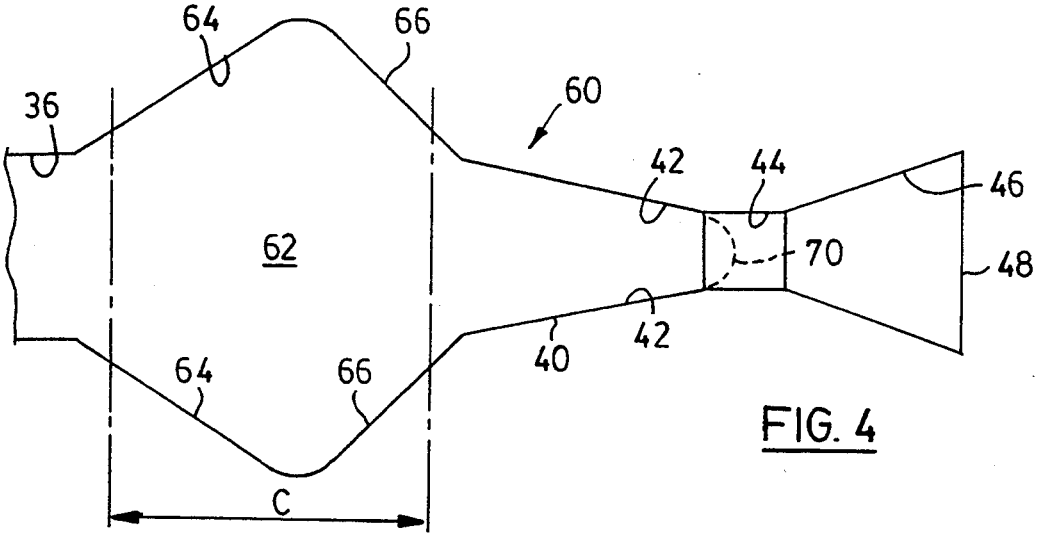
FIG. 4 is a view, broken away, of a second embodiment of a pouch according to the present invention.
Figure 7:
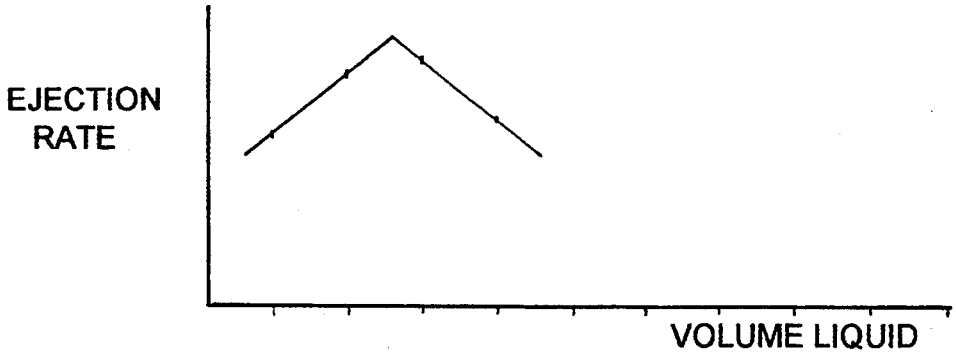
FIG. 7 is a graph of rate of liquid expelled from the pouch illustrated in FIG. 4 plotted against volume of liquid expelled per unit length of travel of the cam used to dispense liquid from the pouch.

A partial view showing the shot chamber and outlet passageway of another embodiment of a fluid pouch 60 constructed in accordance with the present invention is shown in FIG. 4. The shot chamber 62 is bulged and comprises diverging side edges 64 leading from side edges 36 and converging side edges 66 leading to outlet passageway 40. The graph in FIG. 7 illustrates the initially increasing then decreasing rate of liquid expelled from pouch 60 plotted against volume of liquid expelled per unit length of travel of a roller of a fluid dispenser mechanism over the bulging section of shot chamber 62 marked by arrow C in FIG. 4.

Figure 5:
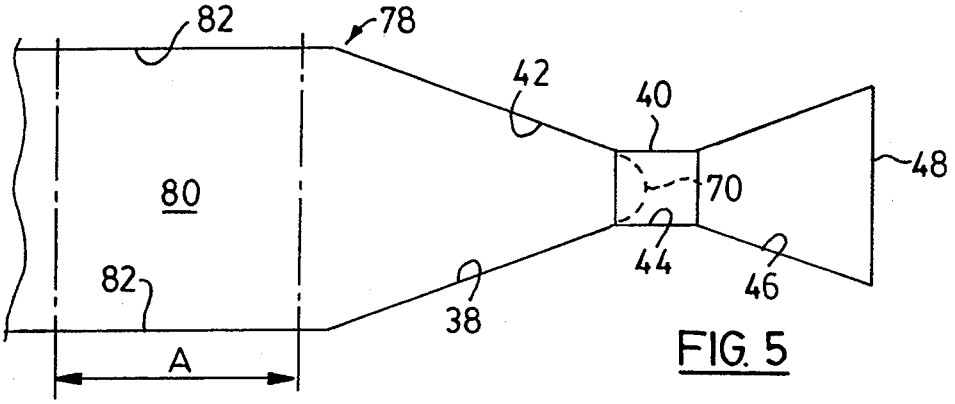
FIG. 5 is a view, broken away, of another embodiment of a pouch according to the present invention.
Figure 8:
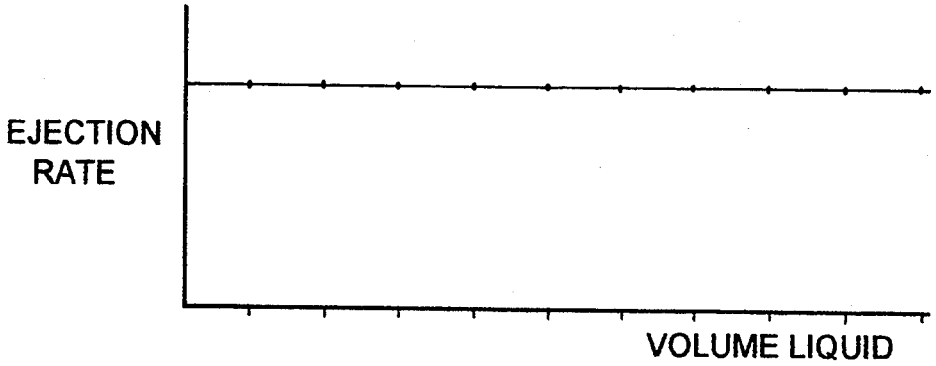
FIG. 8 is a graph of rate of liquid expelled from the pouch illustrated in FIG. 5 plotted against volume of liquid expelled per unit length of travel of the cam used to dispense liquid from the pouch.

Other pouches constructed in accordance with the present invention may have shot chambers with different structures than illustrated in FIGS. 1 or 4. FIG. 5 illustrates a portion of a pouch 78 comprising a shot chamber 80 defined by parallel edges or seams 82, the ambit of motion of the roller being indicated by arrow A. The graph in FIG. 8 illustrates the constant rate of liquid expelled from pouch 78 plotted against volume of liquid expelled per unit length of travel of the roller over shot chamber 80 as shown by arrow A in FIG. 5.

Figure 6:
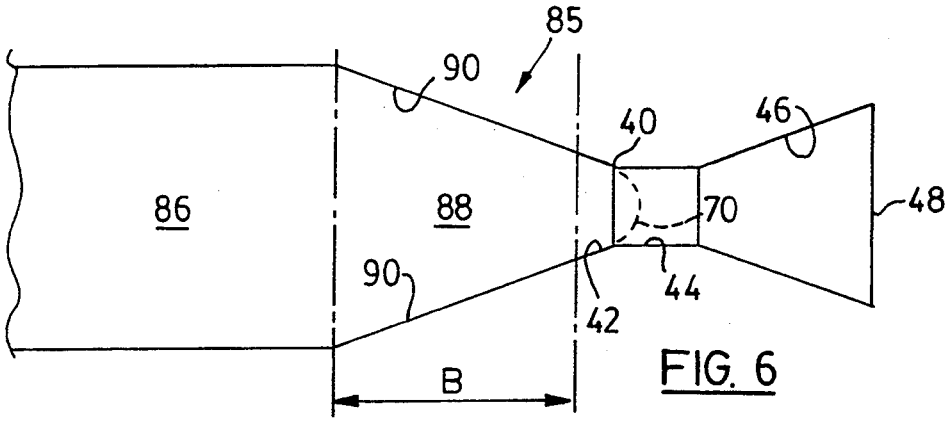
FIG. 6 is a view, broken away, of the yet another pouch constructed in accordance with the present invention.
Figure 9:
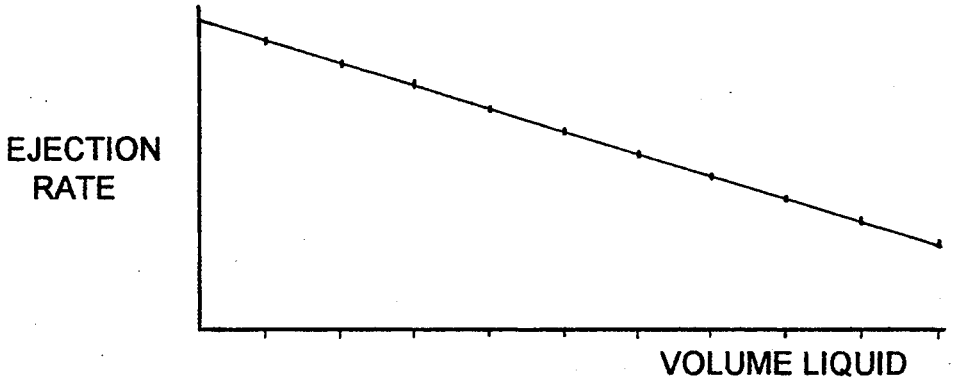
FIG. 9 is a graph of rate of liquid expelled from the pouch illustrated in FIG. 6 plotted against volume of liquid expelled per unit length of travel of the cam used to dispense liquid from the pouch.

FIG. 6 illustrates another arrangement wherein a pouch 85 comprises a liquid storage compartment 86 in flow communication with a shot chamber 88 having tapered edges or seams 90 collinear with tapered section 42 of the venturi-shaped outlet passageway 40. The graph in FIG. 9 illustrates the constantly decreasing rate of liquid expelled from pouch 85 plotted against volume of liquid expelled per unit length of travel of the cam over shot chamber 88 and outlet passageway marked by arrow B.

The dimensions of the venturi shaped outlet passageway may be varied depending on the liquid contained within the pouch. The more viscous the liquid the larger the dimensions to provide smooth flow. The portions of sheets 12 and 14 forming shot chamber 34 and the upper part of passageway 40 are suitably dimensioned and converge in such a way that a liquid meniscus forms in throat 44 of the outlet passageway unless the pressure of the fluid within the shot chamber exceeds a predetermined value. The formation of the meniscus prevents leakage from throat 44. The venturi shaped outlet passageway and the formation of meniscus 70 acts to prevent fluid being expelled from the pouch using finger pressure or by hand squeezing.

Non-limiting examples of fluid dispensers which may be used in conjunction with the fluid pouches of the present invention are disclosed in copending U.S. Ser. No. 661,310 filed Feb. 27, 1991; U.S. Ser. No. 916,436 filed Jul. 21, 1992 and U.S. Ser. No. 000,247 filed Jan. 4, 1993.

Figure 10:
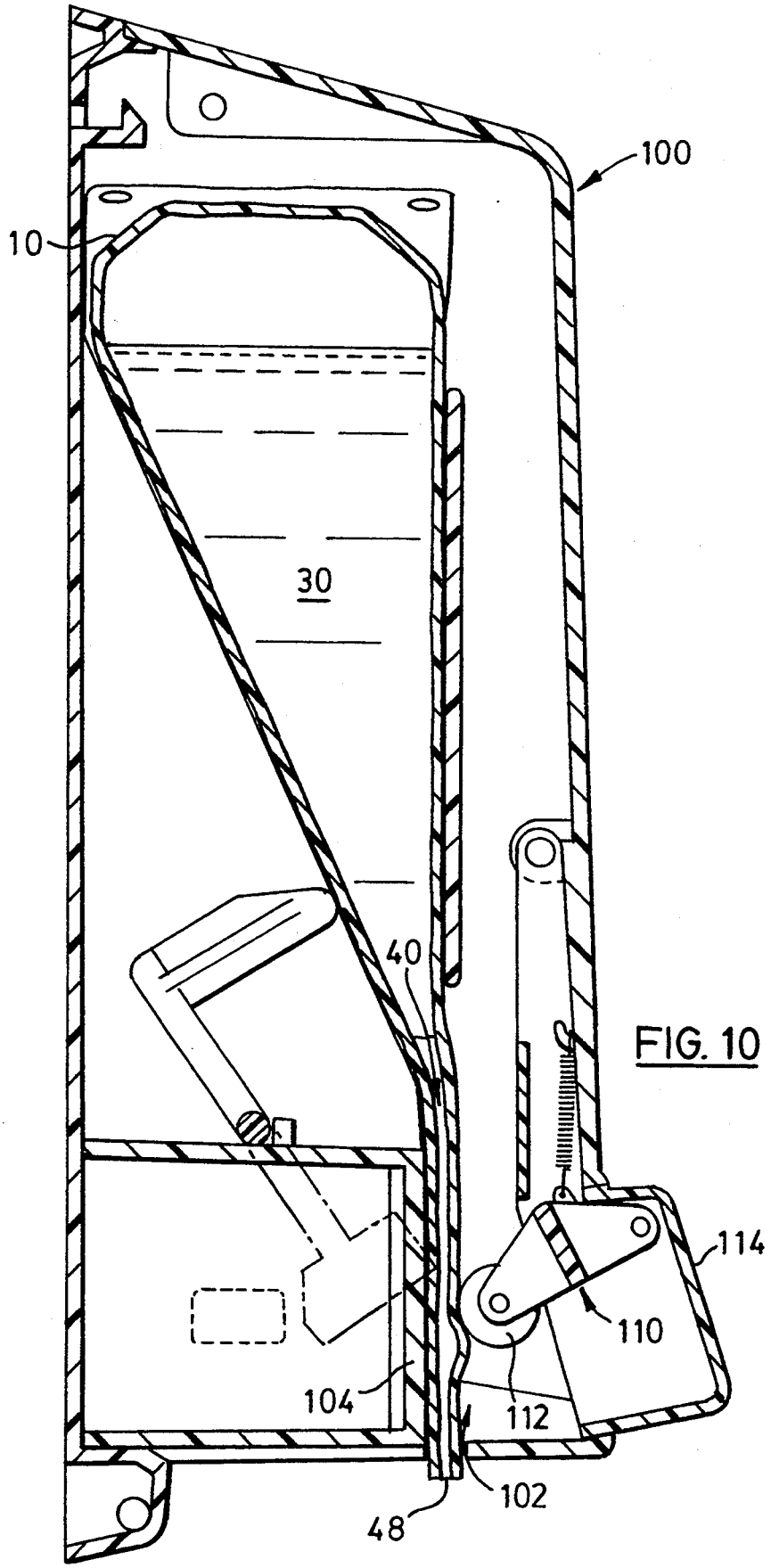
FIG. 10 is a sectional side view of a non-limiting representative fluid dispenser which may be used in conjunction with the pouch of the present invention.

Referring to FIG. 10, a non-limiting example of a fluid dispenser 100 disclosed in U.S. Ser. No. 000,247 for dispensing a fluid from dispenser pouch 10 comprises a dispenser station through which the fluid is to be dispensed along a dispenser path 102 that extends therethrough and a backstop 104 on one side of the dispenser path. Dispenser 100 includes a cam 110 shown comprising a roller 112 confronting backstop 104 and located on the other side of dispenser path 102, a pushbutton 114 for actuating cam 110 pivotally connected to a roller 112 which moves downwardly along the backstop 104 with flexible shot-chamber 34 between cam 110 and backstop 104 to expel a quantity of fluid from dispenser 100.

With reference to FIGS. 1 and 10, in operation, with shot chamber 34 filled with fluid such as soap and sealing tab 50 removed, pushbutton 114 is depressed so that roller 112 first pinches off or seals shot chamber 34. Further depression of pushbutton 114 causes roller 112 to travel down shot chamber 34 thereby compressing the latter between the roller and backstop 104. Upon being pressurized by roller 112, throat 44 of passageway 40 develops a circular cross section and fluid is forced through outlet passageway 40. The end portion of tapered section 46 adjacent discharge outlet 48 remains generally rectangular in cross section having a width smaller than the diameter of throat 44. When the liquid shot has been expelled and roller 112 retracted, throat 44 collapses and backflow of the liquid prevents after drip. Outlet 48 remains substantially the same shape.

Referring to FIGS. 2, 4–6, it is the conical or tapered portion of the outlet passageway extending from the shot chamber which causes meniscus 70 to form when the pouch is unpressurized. Meniscus 70 advantageously acts to prevent leakage from the pouches when not in use. The collapsing of tapered section 46 once the pressure has been relieved acts to pinch off liquid strings which form when viscous fluids are contained within the pouch. In this way leakage from the pouches is significantly reduced if not eliminated altogether.

Thus, while the pliable fluid dispenser pouch having a venturi shaped fluid outlet passageway has been described and illustrated with respect to the various embodiments, it will be appreciated that numerous variations of these embodiments may be made without departing from the scope of the invention disclosed herein.

Therefore what is claimed is:

1. A pliable pouch for storing liquids therein, comprising:

flexible, liquid impermeable superposed sheets being sealed together in liquid-tight relation to enclose therebetween a liquid storage compartment and a flexible shot-chamber in flow communication with said liquid storage compartment, including a venturi shaped outlet passageway extending from said flexible shot-chamber to an associated liquid discharge opening located at a peripheral edge of said liquid tight seal, said venturi shaped outlet passageway including a first tapered portion, a second tapered portion, and an elongate throat portion having opposed ends, the first tapered portion extending from said flexible shot chamber to one end of said elongate throat portion and said second tapered portion extending from the other end of said elongate throat portion to said discharge opening, the pliable pouch including detachable closure means attached to said pouch for blocking said discharge opening.

2. The fluid pouch according to claim 1 wherein said flexible shot chamber includes a bulging portion comprising a diverging portion leading from said liquid storage compartment and a portion converging toward said first tapered portion.

3. The fluid pouch according to claim 2 wherein said flexible shot-chamber is sized to hold therein a predetermined amount of liquid.

4. The fluid pouch according to claim 3 wherein said detachable closure means comprises a tear tab attached to a portion of the peripheral edge adjacent said discharge opening along a weakened line.

5. The fluid pouch according to claim 1 wherein said flexible shot chamber includes a chamber portion defined by parallel edges leading from said liquid storage compartment to said first tapered portion.

6. The fluid pouch according to claim 5 wherein said flexible shot-chamber is sized to hold therein a predetermined amount of liquid.

7. The fluid pouch according to claim 6 wherein said detachable closure means comprises a tear tab attached to a portion of the peripheral edge adjacent said discharge opening along a weakened line.

8. In a fluid pouch having two superposed sheets sealed together in liquid tight relation to form a flexible storage compartment in flow communication with a flexible shot-chamber for dispensing a fluid from a dispenser which comprises, dispenser station through which the fluid is to be dispensed along a dispenser path that extends therethrough, backstop on one side of the dispenser path, cam means confronting the backstop and located on the other side of the dispenser path, means for actuating said cam means to move said cam means downwardly along said backstop with said flexible shot-chamber positioned between said cam means and said backstop to expel a quantity of fluid from said dispenser, the improvement of the fluid pouch comprising:

a venturi shaped outlet passageway extending from said flexible shot-chamber to an associated liquid discharge opening located at the peripheral edge of said liquid tight seal, said venturi shaped outlet passageway including a first tapered portion, a second tapered portion, and an elongate throat portion having opposed ends, the first tapered portion extending from said flexible shot chamber to one end of said elongate throat portion and said second tapered portion extending from the other end of said elongate throat portion to said discharge opening.

9. The fluid pouch according to claim 8 wherein said flexible shot chamber includes a bulging portion comprising a diverging portion leading from said liquid storage compartment and a portion converging toward said first tapered portion.

10. The fluid pouch according to claim 9 wherein said flexible shot-chamber is sized to hold therein a predetermined amount of liquid.

11. The fluid pouch according to claim 10 wherein said detachable closure means comprises a tear tab attached to a portion of the peripheral edge adjacent said discharge opening along a weakened line.

12. The fluid pouch according to claim 8 wherein said flexible shot chamber includes a chamber portion defined by parallel edges leading from said liquid storage compartment to said first tapered portion.

13. The fluid pouch according to claim 12 wherein said flexible shot-chamber is sized to hold therein a predetermined amount of liquid.

14. The fluid pouch according to claim 13 wherein said detachable closure means comprises a tear tab attached to a portion of the peripheral edge adjacent said discharge opening along a weakened line.

* * * * *